US006894646B2

(12) United States Patent
Washiro et al.

(10) Patent No.: US 6,894,646 B2
(45) Date of Patent: May 17, 2005

(54) LINE-SHAPED ANTENNA

(75) Inventors: Takanori Washiro, Tokyo (JP); Isao Tomomatsu, Tokyo (JP); Hiroki Hamada, Tokyo (JP); Shinji Satoh, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 10/150,138

(22) Filed: May 15, 2002

(65) Prior Publication Data

US 2003/0006940 A1 Jan. 9, 2003

(30) Foreign Application Priority Data

May 16, 2001 (JP) ..... 2001-146662
Dec. 12, 2001 (JP) ..... 2001-378639

(51) Int. Cl.[7] ..... H01Q 1/38
(52) U.S. Cl. ..... 343/700 MS; 343/895; 29/600
(58) Field of Search ..... 343/700 MS, 895, 343/846, 848; 29/600

(56) References Cited

U.S. PATENT DOCUMENTS 5,949,383 A * 9/1999 Hayes et al. ..... 343/795
5,955,997 A 9/1999 Ho et al. ..... 343/767
6,111,545 A * 8/2000 Saari ..... 343/702
6,163,300 A * 12/2000 Ishikawa et al. ..... 343/702
6,184,833 B1 * 2/2001 Tran ..... 343/700 MS
6,232,925 B1 * 5/2001 Fujikawa ..... 343/702
6,337,663 B1 * 1/2002 Chi-Ming ..... 343/702
6,356,244 B1 * 3/2002 Mizuno et al. ..... 343/895
6,369,777 B1 * 4/2002 Ohara et al. ..... 343/895

FOREIGN PATENT DOCUMENTS

| | | |
|---|---|---|
| EP | 0 893 841 A1 | 1/1999 |
| EP | 0954 054 A1 | 11/1999 |
| EP | 0 520 197 A2 | 12/1999 |
| JP | 57-99804 | 6/1982 |
| JP | 6-9212 | 2/1994 |
| JP | 10-056313 | 2/1998 |
| JP | 11-163620 | 6/1999 |
| JP | 2000-269718 A | 9/2000 |
| JP | 2001-111322 | 4/2001 |

* cited by examiner

*Primary Examiner*—Tan Ho
(74) *Attorney, Agent, or Firm*—Knobbe Martens Olson & Bear LLP

(57) ABSTRACT

A line-shaped comprises an antenna element in which a strip-shaped conductor is bent in a width direction of a strip, and a chamfered portion is provided on an outer edge of a bent portion of the strip-shaped conductor.

10 Claims, 6 Drawing Sheets

LINE-SHAPED ANTENNA

CROSS-REFERENCE TO RELATED APPLICATION

This application is based upon and claims the benefit of priority from the prior Japanese Patent Applications No. 2001-146662, filed May 16, 2001; and No. 2001-378639, filed Dec. 12, 2001, the entire contents of both of which are incorporated herein by reference.

BACKGROUND OF THE INVENTION

1. Field of the Invention

The present invention relates to a small-sized line-shaped antenna for use in terminal apparatuses such as a cellular phone, portable information terminal, and radio local area network (LAN).

2. Description of the Background Art

A line-shaped antenna (hereinafter referred to simply as the "antenna") includes, for example, a conductor in which an antenna element is formed in a meander form (hereinafter referred to sometimes as the "meander antenna"). Usually, the antenna element of the meander antenna is formed by etching a pattern of a metal plate attached to a dielectric substrate or by punching the element from the metal plate. Therefore, the antenna element is a thin strip-shaped conductor which has a certain degree of width.

However, when the number of bends of the strip-shaped conductor increases, the meander antenna tends to have a narrowed bandwidth.

Moreover, as the above-described line-shaped antenna, an antenna of the antenna element formed integrally with a resin molded material is known. The line-shaped antenna is manufactured by an insert molding. In the insert molding, the antenna element is set in a cavity of a mold, and a resin is injection-molded. When the antenna element has a meander pattern (the conductor has a thin strip shape) punched or etched from the thin metal plate as described above (all patterns are meander patterns in some case and some of the patterns are meander patterns in other case), and when the line-shaped antenna is manufactured in the above-described method, the meander pattern is easily deformed by a flow of resin during the injection molding.

To solve the problem, the antenna element is formed as follows. An integral conductor pattern is formed such that the antenna element is connected to a broad frame provided outside the element via a large number of connection portions. Moreover, to perform the injection molding, the frame and connection portions are held by the mold so that the meander pattern is not deformed.

However, when the meander pattern is complicated, the meander pattern cannot be connected to the frame via the connection portion in a certain portion, and the corresponding portion is easily deformed.

To prevent the meander pattern from being deformed, it is effective to broaden the width of the strip-shaped conductor or increase the thickness thereof. However, there is a problem that a resonance frequency rises.

BRIEF SUMMARY OF THE INVENTION

An object of the present invention is to provide an improved antenna.

A line-shaped antenna according to a first aspect of the present invention is a line-shaped antenna having broader band.

Concretely, a line-shaped antenna according to the first aspect of the present invention comprises an antenna element in which a strip-shaped conductor is bent in a width direction of a strip, and is characterized in that a chamfered portion is provided on an outer edge of a bent portion of the strip-shaped conductor.

Since the chamfered portion is provided, it is possible to broaden the band of the antenna.

Additionally, the whole length of the conductor pattern is determined so that the electric length is substantially n/4 (n is a positive integer, usually, n=1) of the wavelength $\lambda$ of the frequency received/transmitted by the antenna.

In the antenna of the present invention, a size of the chamfered portion (a length of one of two equal sides of a chamfered isosceles triangular portion) is preferably 0.7 times or more as much as a conductor width of a strip-shaped conductor.

A line-shaped antenna according to a second aspect of the present invention is a line-shaped antenna in which deformation of a meander antenna does not easily occur during molding of a resin molded material, and antenna properties are stable.

Concretely, a line-shaped antenna according to the second aspect of the present invention is characterized in that a size of the chamfered portion (a length of one side of two equal sides of the chamfered portion in an isosceles triangular shape) is set to be 0.7 times or more as much as a conductor width of the strip-shaped conductor. Here, it is preferable that the corner portion on which the fillet portion is provided is a corner portion which is easily deformed during resin molding.

During the resin molding, deformation easily occurs in a corner portion which is apart from the connection portion with the frame outside the meander pattern in many cases. Therefore, it is preferable that the corner portion with the fillet portion provided therein is positioned apart from a connection portion which connects the meander pattern to a frame.

Moreover, when the antenna element has a plurality of meander patterns different from one another in a meander direction, the corner portion with the meander direction changed therein cannot generally be provided in the connection portion with the frame, and is easily deformed during the resin molding. Therefore, it is preferable to provide a fillet portion in this corner portion.

With the antenna element having the meander pattern, it is preferable to chamfer the outer surface of the corner portion of the meander pattern as described above. However, it is preferable not to chamfer the outer surface of the corner portion in which the fillet portion is provided. This is because for the corner portion reinforced by providing the fillet portion, it is preferable not to chamfer the portion and to further reinforce the portion.

Furthermore, when the deformation easily occurs during the resin molding, in two adjacent corners constituting one line portion, the fillet portion is not provided and the corner portion closer to a center of the resin molded material of the antenna element is not chamfered, and the fillet portion is preferably provided and the corner portion apart from the center is not chamfered. As a reason for this, when the corner portion closer to the center of the antenna element is thickened, a frequency fluctuation increases.

Additionally, for the antenna element, first and second meander patterns different from each other in the meander direction are provided so that meander pitch directions cross at right angles to each other. The first meander pattern has a corner portion provided in the vicinity of a gate via which a resin is injected during the resin molding, and a corner portion provided apart from the gate. The fillet portion is preferably provided in a corner portion which is adjacent to the corner portion provided in the vicinity of the gate.

Furthermore, it is preferable that the antenna element includes a meander pattern in which two meander patterns having different meander directions and different widths are connected to each other via a connection portion, and the connection portion and two corner portions on a broader meander pattern side connected via the connection portion are not chamfered.

It is preferable that the antenna element further includes at least one of a third corner portion on which the chamfer is not formed, and a fourth corner portion having a fillet portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 1A is a front view, FIG. 1B is a side view, and FIG. 1C is a back view;

FIG. 2A is a front view, FIG. 2B is a side view, and FIG. 2C is a back view;

FIG. 5A is a front view, FIG. 5B is a side view, and FIG. 5C is a back view;

DETAILED DESCRIPTION OF THE INVENTION

Embodiments of the present invention will be described hereinafter in detail with reference to the drawings.

(First Embodiment)

Figure 1A:
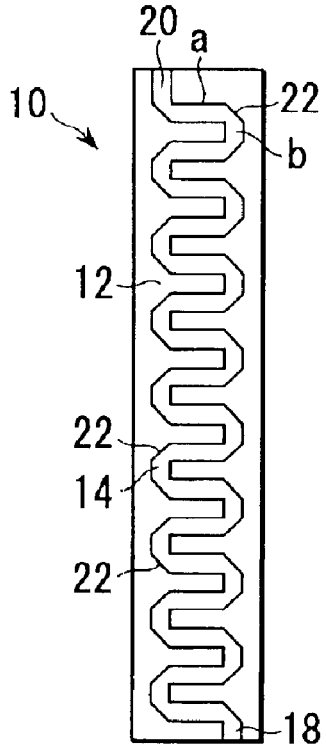
FIGS. 1A to 1C are diagrams showing a meander antenna according to a first embodiment of the present invention.
Figure 1B:
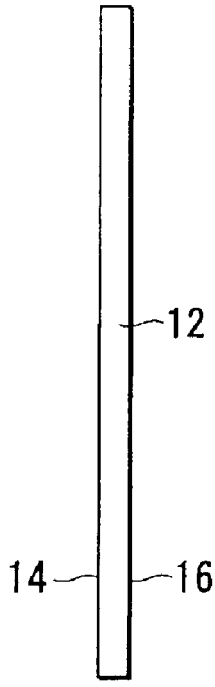
Figure 1C:
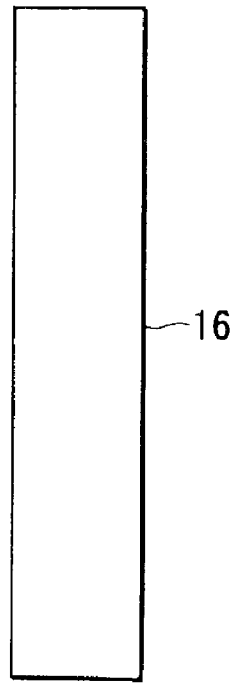

FIGS. 1A to 1C are diagrams showing a line-shaped antenna according to a first embodiment of the present invention.

A line-shaped antenna 10 includes an antenna element 14 having a strip-shaped conductor formed in a meander form on one surface of a dielectric substrate 12, and a metal plate 16 formed on the other surface thereof. The antenna element 14 has a length of substantially ¼ wavelength, one end thereof is a power supply portion 18, and the other end is a release end 20. That is, the metal plate 16 functions as a parasitic element, not as a ground plate. The antenna element 14 has a width direction straight portion a extending straight in a width direction of a meander and a pitch direction straight portion b extending straight of a pitch direction of the meander, and the width direction straight portion a and pitch direction straight portion b form right angles. That is, the antenna element 14 is formed so as to be bent at right angles. The line-shaped antenna 10 according to the first embodiment is manufactured, for example, as follows. A double-sided copper foil substrate (thickness of a copper foil is 36 $\mu$m) cut in a predetermined with and length is prepared. Moreover, the copper foil on one surface of the substrate is etched, punching-molded, or printed to form the antenna element 14.

The line-shaped antenna 10 according to the first embodiment is characterized in that an outer edge of a portion of the strip-shaped conductor of the antenna element 14 bent at right angles is cut in an isosceles triangular shape. That is, the first embodiment is characterized in that each of chamfered portions 22 is cut along a line crossing at right angles to a line by which an angle formed by the straight portions a and b is equally divided into two. Concretely, the chamfered portion 22 is cut at an angle of 45° with respect to the pitch direction.

In the line-shaped antenna whose antenna element 14 is short as compared with the wavelength of a resonance frequency, and which resonates and operates, it is not considered that portions such as the corner portion of the meander-shaped bent portion do not influence a width of a band of the antenna. Additionally, when the inventor of the present application formed the chamfered portions 22 as described above, it is possible to broaden a bandwidth as compared with when there are not chamfered portions. The reason is not clear, but according to the present inventor, when the chamfered portions 22 are provided, a change of impedance in the bent portions of the antenna element 14 is reduced, unnecessary reflection can be prevented, and the decrease of the bandwidth is supposedly prevented.

TRIAL EXAMPLE 1

Figure 2A:
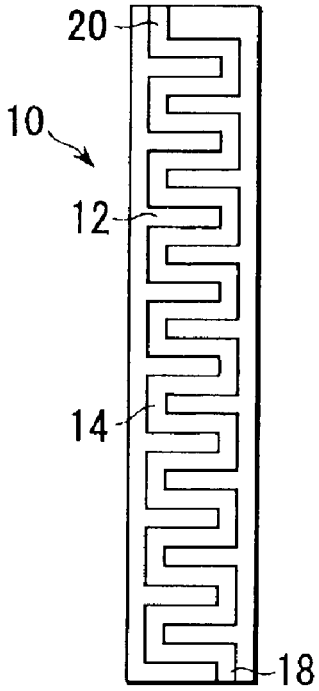
FIG. 2A (PRIOR ART)
FIGS. 2A to 2C are diagrams showing a conventional meander antenna.
Figure 2B:
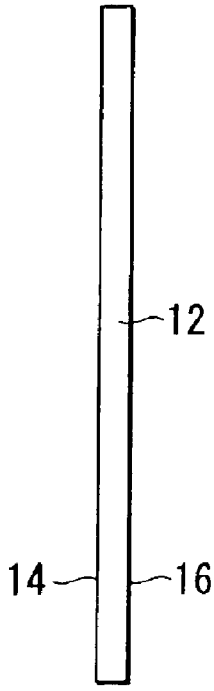
FIG. 2B (PRIOR ART)
Figure 2C:
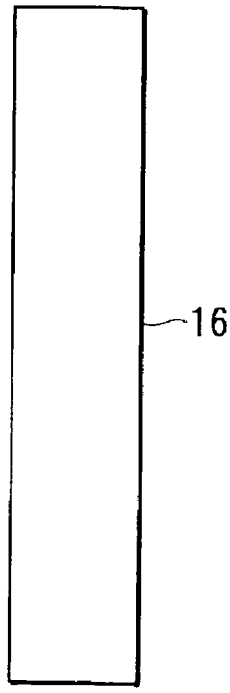
FIG. 2C (PRIOR ART)
Figure 3:
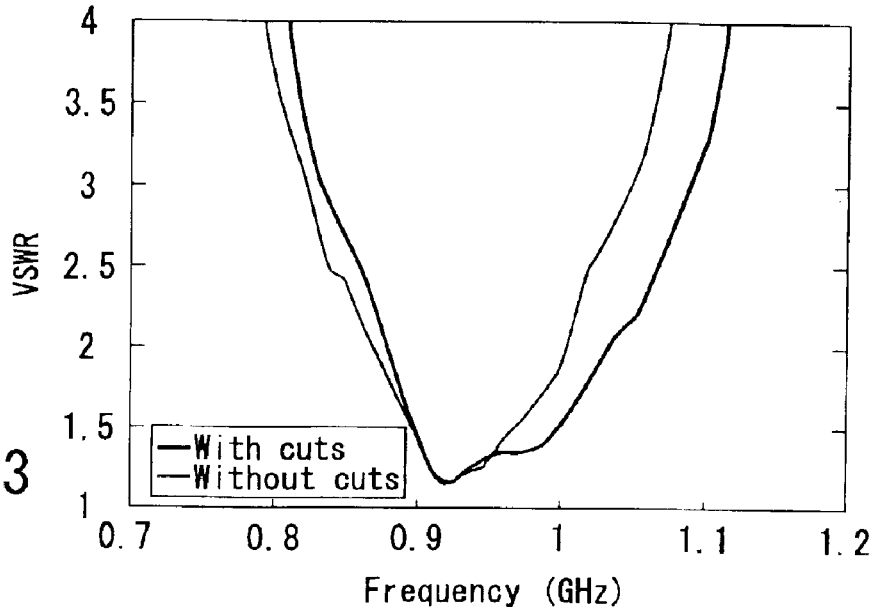
FIG. 3 is a graph showing test results of the meander antennas of FIGS. 1A to 1C and 2A to 2C.

Comparison test results of a line-shaped antenna according to the first embodiment of the present invention and a conventional line-shaped antenna experimentally manufactured will be described. As the line-shaped antenna according to the first embodiment of the present invention, the line-shaped antenna 10 having the chamfered portions 22 as shown in FIGS. 1A to 1C are experimentally manufactured. For the experimentally manufactured line-shaped antenna 10, the dielectric substrate 12 has a length of 36 mm, width of 8 mm, and thickness of 1.6 mm. The antenna element 14 has a conductor width of 1 mm, conductor interval of 1 mm, and meander width of 6 mm. Moreover, the metal plate 16 has the same length and width as those of the dielectric substrate 12. For comparison with the above-described experimentally manufactured example, as the conventional line-shaped antenna, the line-shaped antenna 10 shown in FIGS. 2A to 2C is experimentally manufactured, and is the same as the line-shaped antenna 10 of FIGS. 1A to 1C except that the bent portions of the antenna element 14 are not chamfered. Changes of voltage standing wave ratios (VSWR) of a time at which the frequencies of the line-shaped antenna according to the first embodiment and conventional line-shaped antenna are changed are measured. Measurement results are shown in a graph of FIG. 3. A bold line with cuts (with the chamfered portions) shows properties of the line-shaped antenna according to the first embodiment, and a thin line without any cut shows the properties of the conventional line-shaped antenna. The bandwidths in a plurality of VSWR levels obtained from the measurement results are shown in Table 1.

TABLE 1

| | Bandwidth | |
|---|---|---|
| | Antenna of the present invention with chamfered portions | Conventional antenna without chamfered portions |
| VSWR < 3 | 259 MHz | 226 MHz |
| VSWR < 2.5 | 207 MHz | 185 MHz |
| VSWR < 2 | 154 MHz | 135 MHz |
| VSWR < 1.5 | 103 MHz | 74 MHz |

According to the results shown in Table 1, when the chamfered portions 22 are provided on the outer edges of the bent portions of the antenna element, it is clear that the frequency bandwidth can be set to be broader than that of the conventional line-shaped antenna.

TRIAL EXAMPLE 2

An example in which the size of the chamfered portion 22 is changed will be described.

Figure 4A:
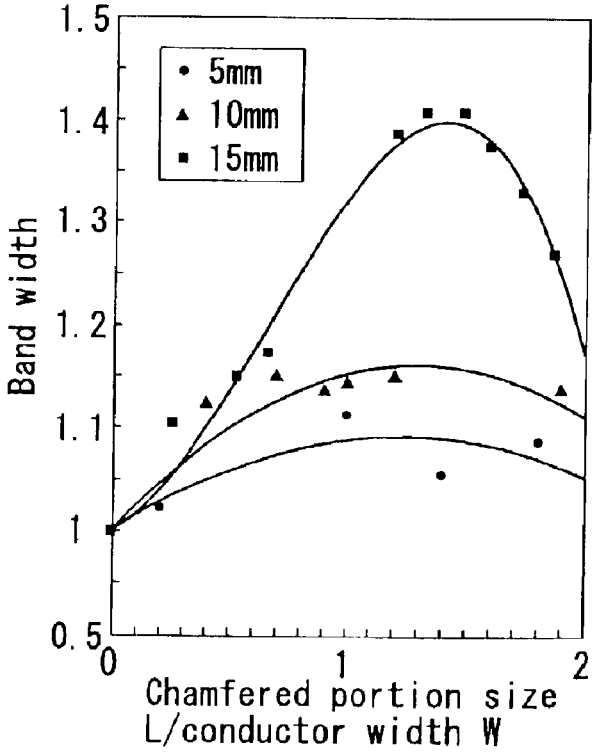
FIG. 4A is a graph showing a relation between a width (size) and a bandwidth of a chamfered portion of the meander antenna according to the present invention.
Figure 4B:
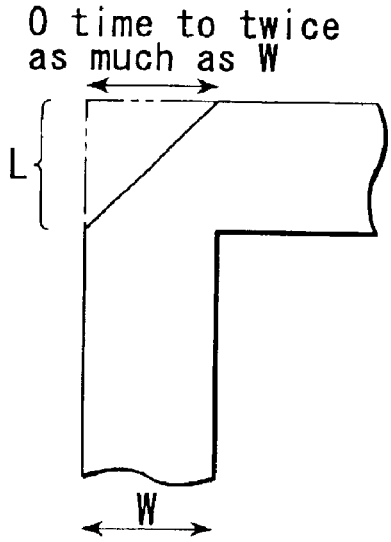
FIG. 4B is an explanatory view showing definition of the size of the chamfered portion.

As shown in FIG. 4B, three types of line-shaped antennas having conductor widths of 5 mm, 10 mm, and 15 mm are prepared. Moreover, the bandwidths are measured, when the size (length L of one of two equal sides of the portion chamfered in a right-angled isosceles triangle) of the chamfered portion is changed in a range of 0 to twice the conductor width W. Measurement results are shown in FIG. 4A. As shown in FIG. 4A, when the bandwidth without any chamfered portion is set to 1, and when the chamfered portions are provided, it is seen that the respective bandwidths change as follows.

(1) Conductor width 5 mm: bandwidth 1.00 to 1.09 (Maximum change amount $\Delta M=0.09$)

(2) Conductor width 10 mm: bandwidth 1.00 to 1.16 (Maximum change amount $\Delta M=0.16$)

(3) Conductor width 15 mm: bandwidth 1.00 to 1.40 (Maximum change amount $\Delta M=0.40$)

In FIG. 4A, the change amount of the bandwidth is $\Delta M/2$ or more, when the size of the chamfered portion is 0.7 times or more as much as the conductor width W, and the effect of the broadened band is remarkable especially in this range. Therefore, the size of the chamfered portion is preferably set to 0.7 times or more as much as the conductor width W.

(Second Embodiment)

Figure 5A:
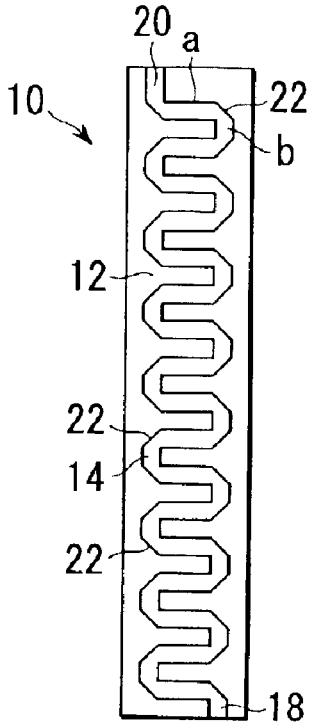
FIGS. 5A to 5C are diagrams showing the meander antenna according to a second embodiment of the present invention.
Figure 5B:
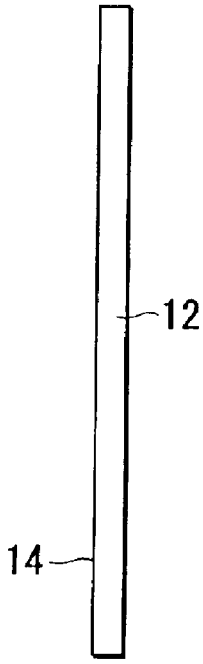
Figure 5C:
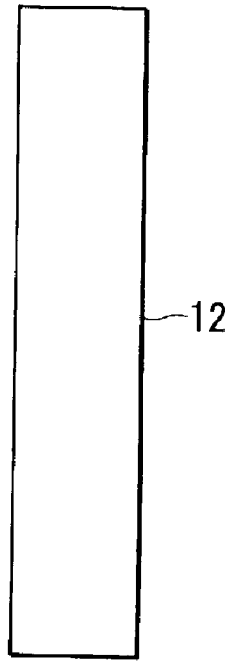

FIGS. 5A to 5C are diagrams showing the line-shaped antenna according to a second embodiment of the present invention. In FIGS. 5A to 5C, the same part as that of FIGS. 1A to 1C is denoted with the same reference numerals, and detailed description thereof will be omitted.

In the line-shaped antenna 10 according to the second embodiment, the antenna element 14 having the meandering strip-shaped conductor is formed on one surface of the dielectric substrate 12, but the metal plate is not provided on the other surface of the dielectric substrate 12. As in the line-shaped antenna according to the second embodiment, even in the configuration in which the metal plate is omitted, the band of the antenna can be broadened.

(Third Embodiment)

Figure 6:
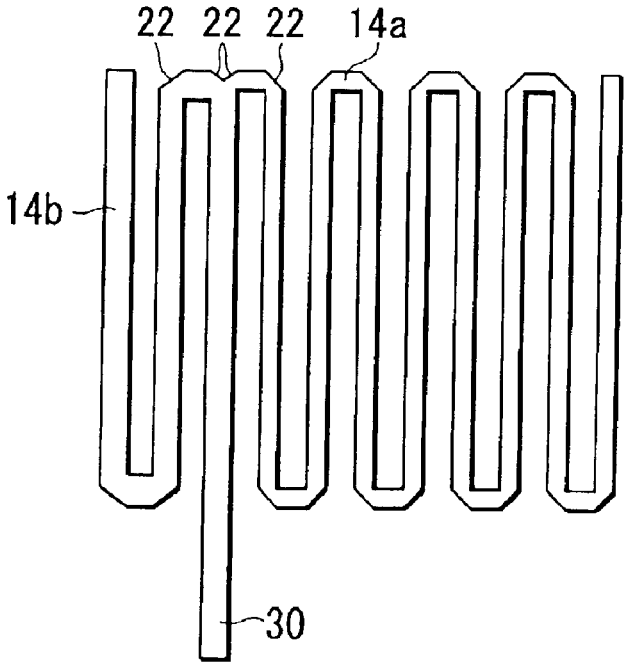
FIG. 6 is a front view showing a third embodiment of the present invention.

FIG. 6 shows a third embodiment showing an example in which the line-shaped antenna according to the present invention is applied to a 2-frequencies master antenna. In the antenna according to a third embodiment, a conductor antenna is branched into two in the vicinity of a power supply portion 30 (referred to as the "branched portion"), and a first antenna element 14*a* is connected to a second antenna element 14*b*. Moreover, when the branched portion is cut substantially in a V shape, the chamfered portion 22 is formed.

The first to third embodiments show most effective chamfered portions 22 formed by cutting the corners of the strip-shaped conductors along straight lines. This is not limited to, and the chamfered portion may be formed by cutting the outer surface of the (bent) corner in which the straight portions intersect each other along a curve such as a circular arc having a predetermined radius. Moreover, to maintain the conductor width even in the chamfered portion 22, the portion may of course have a shape such that the conductor is swelled to the inside of the corner, that is, such that the inner side of the corner is also chamfered.

As described in the respective embodiments, when the chamfered portion is provided on the outer edge of the bent portion of the strip-shaped conductor, the antenna having a band broader than conventional can be obtained.

(Fourth Embodiment)

The above-described respective embodiments show the line-shaped antenna in which frequency properties are improved by providing the chamfered portions. However, if the chamfered portions are provided on all corners, a problem occurs that the strength is degraded. A fourth embodiment is an embodiment for solving this problem.

Figure 7:
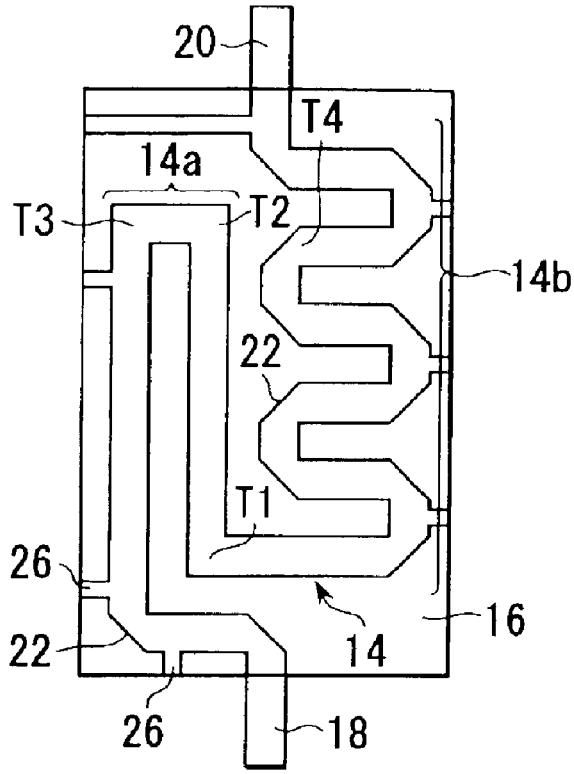
FIG. 7 is a plan view showing a line-shaped antenna according to a fourth embodiment of the present invention.

FIG. 7 is a diagram showing the line-shaped antenna according to the fourth embodiment of the present invention. The line-shaped antenna according to the fourth embodiment includes the antenna element 14 having two meander patterns 14*a*, 14*b* whose meander directions are different. The antenna element 14 is buried in the resin molded material 12 having a flat plate shape. The power supply terminal 18 is formed on one end of the antenna element 14 so as to extend out of the resin molded material 12, and the fixed terminal 20 is formed on the other end of the element so as to extend out of the resin molded material 12.

The above-described line-shaped antenna is manufactured as follows.

Figure 8:
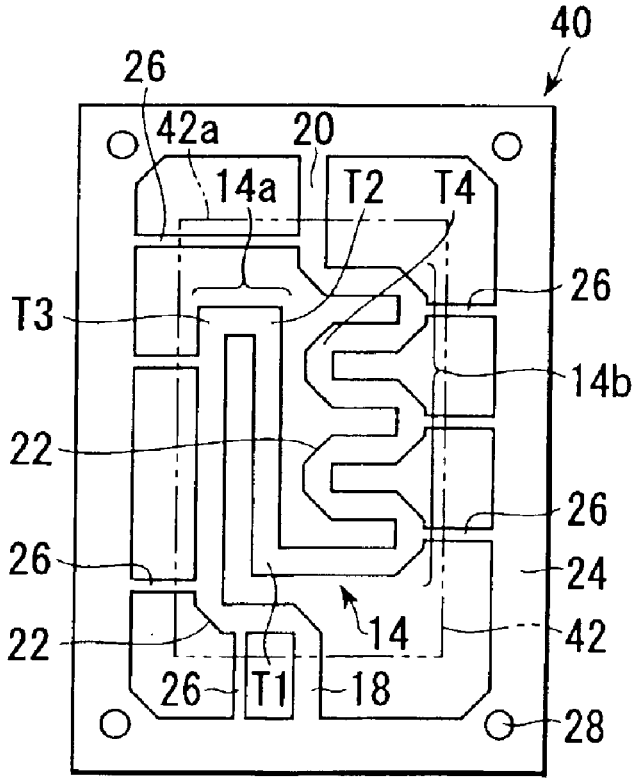
FIG. 8 is a plan view showing a conductor pattern for use in manufacturing the line-shaped antenna of FIG. 7.

First, a conductor pattern 40 shown in FIG. 8 is formed by punching or etching a thin metal plate (e.g., a copper plate). The conductor pattern 40 holds the antenna element 14 having two meander patterns 14*a,* 14*b* which are provided in a quadrangular broad frame 24 and which have different meander directions. The antenna element 14 is connected to the frame 24 via connection portions 26 in a plurality of positions. One end of the antenna element 14 is connected to the frame 24 via the power supply terminal 18. The other end of the antenna element 14 is connected to the frame 24 via the fixed terminal 20. Thereby, the antenna element 14 is held in a predetermined positions in the frame 24. FIG. 8 shows positioning holes formed in four corners of the frame 24.

The conductor pattern 40 is set in a mold, and then the injection molding is performed. The conductor pattern 40 is held between an upper mold and a lower mold. When the conductor pattern 40 is held between the molds, a cavity 42 is formed in a frame shown by a two-dots chain line. Therefore, in FIG. 8, the portion outside the two-dots chain line (outer ends of the connection portions 26 of the conductor pattern 40, outer ends of the terminals 18, 20, and frame 24) is held between the molds. A gate for injecting a resin in the cavity 42 is provided on a surface 42*a* of the cavity 42 provided on the side of the fixed terminal 20 of the antenna element 14. After the injection molding is performed through the molds, the connection portions 26 are cut along the peripheral surface of the resin molded material, the power supply terminal 18 and fixed terminal 20 are cut while leaving an appropriate length, and thereby the line-shaped antenna is obtained as shown in FIG. 7.

The antenna element 14 of the line-shaped antenna according to the fourth embodiment has two meander patterns 14*a,* 14*b* whose meander directions are different. Therefore, the meander pattern is complicated. When the meander pattern is complicated in this manner, the connection portions 26 cannot be formed in some corner portions. For example, the connection portions cannot be formed in corner portions $T_1$, $T_2$. These corner portions $T_1$, $T_2$ are easily deformed by the flow of resin during the resin molding. Additionally, the connection portion cannot be formed also in a corner portion $T_4$ inside the second meander pattern 14*b*. However, the second meander pattern 14*b* has a narrow meander width, and is not easily deformed, and there is no problem as it is.

Figure 9:
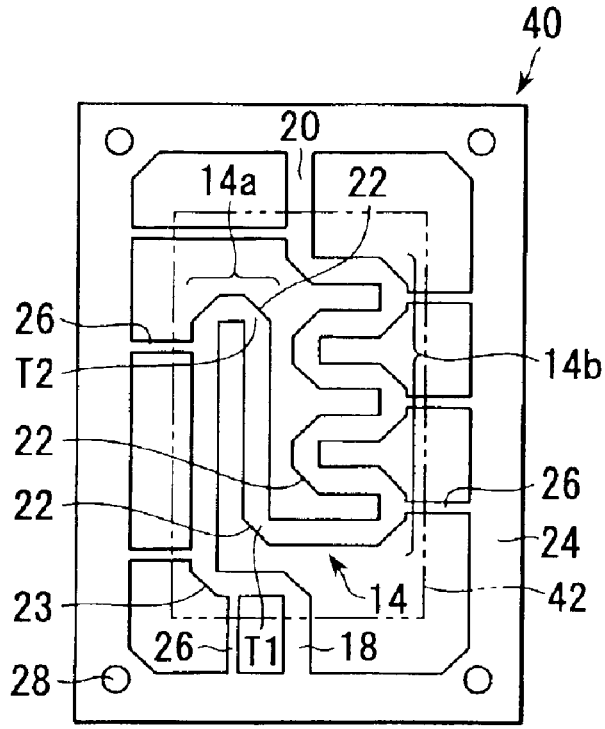
FIG. 9 is a plan view showing the conductor pattern obtained by chamfering all corner portions of FIG. 8.

With the antenna element 14 having the meander pattern, as shown in FIG. 9, it is preferable for the broadened band to provide the chamfered portions 22 in the outer surfaces of all the corner portions. However, if the chamfered portions 22 are provided on the corner portions $T_1$ and $T_2$, which are easily deformed during the resin molding, the reduction of the mechanical strength of the portions is lowered and as a result the deformation is promoted.

To solve the problem, in the fourth embodiment, for the portion (corner portion) in which the connection portion 26 cannot be made and which has a strength problem, the outer surface of the portion is not chamfered, so that the mechanical strength is enhanced.

In the fourth embodiment, the first and second meander patterns 14*a* and 14*b* are provided so that the pitch directions of the meanders cross at right angles to each other. The first meander pattern 14*a* has a larger meander width than that of the second meander pattern 14*b*. During the resin molding, one end of the first meander pattern 14*a* in the meander width direction is provided in the vicinity of the surface 42*a* in which the gate of the cavity 42 is provided, and the other end thereof is provided in a position apart from the surface 42*a*. It is predicted that the resin flowing into the cavity during the resin molding flows substantially along the meander width direction of the first meander pattern 14*a*. The corner portion $T_2$ is provided in a position closer to the gate than the adjacent corner portion $T_1$ during the resin molding. Moreover, the corner portion $T_2$ is provided in the position closer to the gate than an adjacent corner portion $T_3$. In other words, in the first meander pattern 14*a*, the corner portion $T_2$ is closest to the gate, and the corner portions $T_1$ and $T_3$ are provided adjacent to each other to sandwich the corner portion $T_2$. The chamfered portions outside these corner portions $T_1$, $T_2$, $T_3$ are omitted.

Moreover, the gate for injecting the resin during the resin molding usually remains as a gate trace in the resin molded material 30.

In the above-described configuration, the portions in which the connection portions of the first meander pattern 14*a* cannot be made, particularly the periphery of the corner portion $T_2$ are reinforced. Therefore, the antenna element 14 can be prevented from being deformed during the resin molding. As a result, the line-shaped antenna whose properties are stabilized can be obtained. In the fourth embodiment, three corner portions $T_1$, $T_2$, $T_3$ are not chamfered, but the other corner portions are all chamfered. Therefore, most of the corner portions are chamfered. There is little possibility that three non-chamfered corner portions $T_1$, $T_2$, $T_3$ inhibit the band enlargement.

(Fifth Embodiment)

Figure 10:
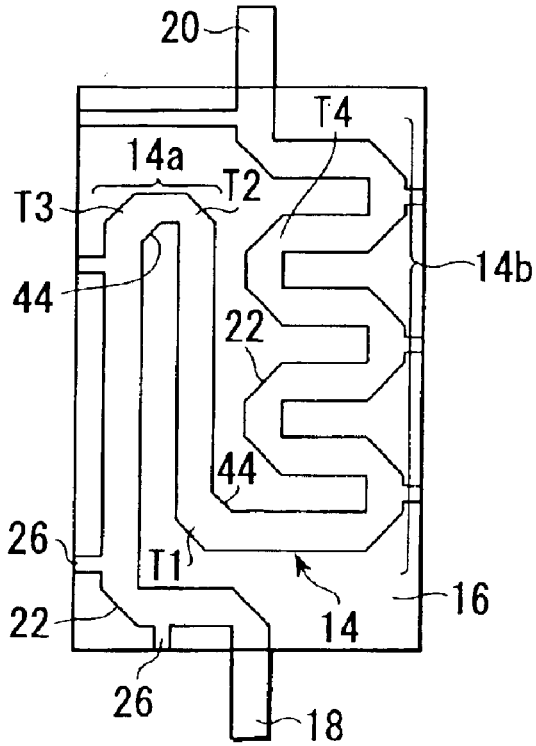
FIG. 10 is a plan view showing the line-shaped antenna according to a fifth embodiment of the present invention.
Figure 11:
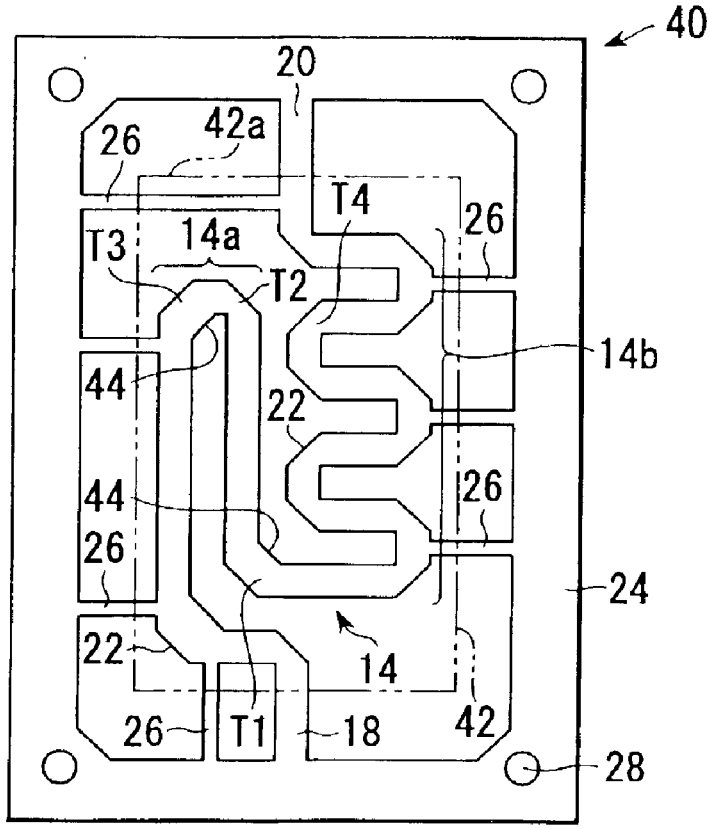
FIG. 11 is a plan view showing the conductor pattern for use in manufacturing the line-shaped antenna of FIG. 10.

FIG. 10 is a diagram showing the line-shaped antenna according to a fifth embodiment of the present invention. FIG. 11 is a diagram showing the conductor pattern 40 for use in the line-shaped antenna according to the fifth embodiment. In FIGS. 10 and 11, the same part as that of FIGS. 7 and 8 is denoted with the same reference numerals.

In the fifth embodiment, the fillet portion 44 is provided inside the corner portions $T_1$, $T_3$, that is, the corner portion whose mechanical strength is weak. Thereby, the conductor width is locally thickened, and the mechanical strength is enhanced.

Figure 12A:
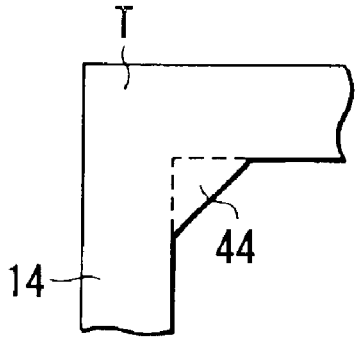
FIGS. 12A and 12B are explanatory views of a fillet portion used in the fifth embodiment of the present invention.
Figure 12B:
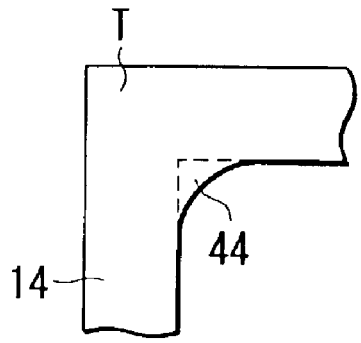

Here, as shown in FIG. 12A or 12B, the "fillet portion" is the portion 44 extending inwards from a corner portion in which straight sides intersect each other inside the antenna element 14 on the corner portion T in which the antenna element 14 is bent. When the fillet portion 44 is provided, the corner portion is reinforced. Therefore, the deformation of the corner portion does not easily occur during the resin molding. Moreover, when the fillet portion 44 is provided, the conductor width of the corresponding portion is broadened. However, since the conductor width is locally broadened, the resonance frequency can be prevented from rising.

FIGS. 12A and 12B show an example in which the corner portion is not chamfered. However, the chamfered portion 22 may be provided in the portion in which the fillet portion 44 is provided as in the first to-third embodiments. In this manner, even when the chamfered portion 22 is provided, the sufficient strength of the corner portion can be kept.

It is preferable for the strength to provide the fillet portion 44 also on the corner portion $T_2$ similarly as the corner portion $T_1$. However, if the fillet portions 44 are provided on the corner portions provided adjacent to each other, it is not preferable because of increasing the frequency fluctuation. This is supposedly because the electric length of a crank-shaped portion including these corner portions is remarkably reduced.

When an explanation will be performed by the figure of FIG. 11, for adjacent two corner portions $T_1$, $T_2$ constituting the straight portion of the meander pattern, the fillet portion 44 is provided on the corner portion $T_2$ closer to the resin molded material center of the antenna element 14. When the corner portion $T_2$ is thickened in this manner, particularly the frequency fluctuation tends to increase. A volume of a dielectric material provided around the conductor is considered to be a cause. Concretely, the reason is as follows. Since the conductor buried in the vicinity of the periphery of a dielectric chip (resin molded material) is positioned in the peripheral portion of the chip, a dielectric constant contributes also with an outside state (air). Therefore, an effective dielectric constant drops, and the effect obtained from the wavelength reduction by the dielectric material is not large toward the center portion of the chip. Therefore, a large fluctuation of the frequency by the change of the conductor length is not generated. However, the conductor in the vicinity of the middle of the conductor chip has a small air contribution ratio as compared with the conductor provided in the peripheral portion. As a result, the effective dielectric constant of the conductor in the vicinity of the chip middle is high, and the wavelength reduction effect is also large. Therefore, it is considered that a slight conductor length change produces a large frequency change.

Therefore, in the fifth embodiment, the fillet portion is not provided on the corner portion $T_2$ closer to the resin molded material center of the antenna element 14, but the fillet portion 44 is provided on the corner portions $T_1$, $T_3$ closer to the outer surface of the resin molded material 12 (on the corner portion apart from the center). This enhances the mechanical strength of whole antenna element, and further reduces the frequency fluctuation.

Moreover, in FIG. 11, the fillet portions 44 are provided both on the corner portions $T_1$, $T_3$. The outer surfaces of these corner portions $T_1$, $T_2$, $T_3$ are chamfered, but the mechanical strength of the antenna element may be more improved with no chamfers.

In the fourth and fifth embodiments, an example in which the antenna element 14 is buried in the resin molded material 12 is described. However, this is not limited to. For example, in the line-shaped antenna according to the embodiment of the present invention, the antenna element 14 may be provided integrally in the surface of the resin molded material 12. In this case, as a mold for molding the resin molded material, the cavity is formed in either one of the upper and lower molds. When such mold is used, the antenna element may be set in the mold surface of the mold with no cavity formed therein in order to perform the injection molding.

According to the fourth and fifth embodiments, in the line-shaped antenna in which the antenna element including the meander pattern is formed integrally in the resin molded material, the meander pattern can be prevented from being deformed during the molding of the resin molded material. Therefore, the line-shaped antenna whose antenna properties are stabilized can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A line-shaped antenna comprising:

an antenna element in which a strip-shaped conductor is bent in a width direction of a strip, wherein a chamfered portion is provided on an outer edge of a bent portion of the strip-shaped conductor, and wherein a size of the chamfered portion (a length of one side of two equal sides of the chamfered portion in an isosceles triangular shape) is set to be 1.2 times or more of a conductor width of the strip-shaped conductor.

2. The line-shaped antenna of claim 1, wherein a size of the chamfered portion is set to be approximately 1.4 times a conductor width of the strip-shaped conductor.

3. A line-shaped antenna comprising:

an antenna element having a meander pattern of a strip-shaped conductor;

a resin molded material molded to be integral with the antenna element; and a fillet portion provided on an inner surface of at least one corner portion of a plurality of corner portions of the meander pattern, wherein the corner portion with the fillet portion provided therein is positioned apart from a connection portion which connects the meander pattern to a frame.

4. The line-shaped antenna according to claim 3, wherein the antenna element includes a plurality of meander patterns whose meander directions are different, and the fillet portion is provided on the corner portion in which the meander direction changes.

5. The line-shaped antenna according to claim 3, wherein the antenna element includes a first corner portion whose outer surface is chamfered, and a second corner portion whose outer surface is not chamfered and on which the fillet portion is provided.

6. The line-shaped antenna according to claim 5, wherein when the deformation easily occurred during the resin molding, the corner portion provided on a portion close to a resin molded material center of the antenna element among two adjacent corner constituting one straight line portion which is easily deformed is not chamfered, and the fillet portion is provided on the corner portion provided in a portion apart from the center.

7. The line-shaped antenna according to claim 5, wherein the antenna element further includes at least one of a third corner portion on which the chamfer is not formed, and a fourth corner portion having a fillet portion.

8. The line-shaped antenna according to claim 3, wherein the antenna element includes a first meander pattern and a second meander pattern whose meander directions are different and which meander pitch directions cross at right angles to each other, and the first meander pattern includes a first corner portion provided in a position close to a gate via which a resin is injected during resin molding and a second corner portion provided in a position apart from the first corner portion, and the fillet portion is provided on a corner portion provided in a position adjacent to the corner portion provided in the position close to the gate.

9. A line-shaped antenna comprising:

an antenna element in which a strip-shaped conductor is bent in a width direction of a strip, wherein a chamfered portion is provided on an outer edge of a bent portion of the strip-shaped conductor, and wherein the antenna element includes a meander pattern in which two meander patterns having different meander directions and different widths are connected to each other via a connection portion, and the connection portion and two corner portions on a broader meander pattern side connected via the connection portion are not chamfered.

10. The line-shaped antenna according to claim 3, wherein the antenna element includes a meander pattern in which two meander patterns having different meander directions and different widths are connected to each other via a connection portion, and the connection portion and two corner portions on a broader meander pattern side connected via the connection portion are not chamfered.

* * * * *